United States Patent [19]

Leonhart

[11] 4,375,112

[45] Mar. 1, 1983

[54] PILLOW TO PROTECT HAIRDO

[76] Inventor: Virginia R. Leonhart, 248 Grant St., Saegertown, Pa. 16433

[21] Appl. No.: 117,831

[22] Filed: Feb. 4, 1980

[51] Int. Cl.[3] ..... A47G 9/00

[52] U.S. Cl. ..... 5/436; 5/490

[58] Field of Search ..... 5/434–436, 5/490, 437, 441; D6/201, 204

[56] References Cited

U.S. PATENT DOCUMENTS

| | | | |
|---|---|---|---|
| D. 174,778 | 5/1955 | Smith | D6/201 |
| D. 256,728 | 9/1980 | Allen | D6/201 |
| D. 256,870 | 9/1980 | Britzman | D6/201 |
| D. 261,681 | 11/1981 | Chandler | D6/204 |
| 2,779,033 | 1/1957 | Fountain | 5/490 |
| 2,958,769 | 11/1960 | Bounds | D6/201 |
| 3,118,152 | 1/1964 | Talley, Jr. | 5/436 |
| 3,276,046 | 10/1966 | Capelli | 5/436 |
| 3,312,987 | 4/1967 | Emery | 5/436 |
| 3,602,928 | 9/1971 | Helzer | 5/436 |
| 3,848,281 | 11/1974 | Mathews | 5/436 |

FOREIGN PATENT DOCUMENTS

| | | | |
|---|---|---|---|
| 1119533 | 7/1970 | United Kingdom | 5/435 |

*Primary Examiner*—Alexander Grosz

*Attorney, Agent, or Firm*—Charles L. Lovercheck; Wayne L. Lovercheck; Dale R. Lovercheck

[57] ABSTRACT

A pillow for protecting a hairdo is disclosed. The pillow is made of foam or the like and has a hole in the center in which the hairdo can be received while the person's cheek rests on the area around the hole. The foam is sealed together around the outside periphery of the pillow and the outside periphery of the hole. A pillow case is provided having a conforming hole in it.

1 Claim, 6 Drawing Figures

PILLOW TO PROTECT HAIRDO

GENERAL DESCRIPTION OF THE INVENTION

A pillow is disclosed herein which will enable a woman to lie comfortably with curlers in her hair and also to keep her hair neat. It is well known that a neat hairdo gives a woman a psychological uplift. The invention involved herein is intended to make a woman feel it is worth her time and expense going to her hair dresser. The inventor has experimented with the present invention for the past year and has frequently been asked how she keeps her hairset from week to week.

OBJECTS OF THE INVENTION

It is an object of the invention to provide an improved pillow.

Another object of the invention is to provide a pillow that is adapted to keep a woman's hair neat for an extended period of time.

Another object of the invention is to provide a pillow with a hole in the center through which a woman can extend her hairdo to protect it while she sleeps.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

Figure 1:
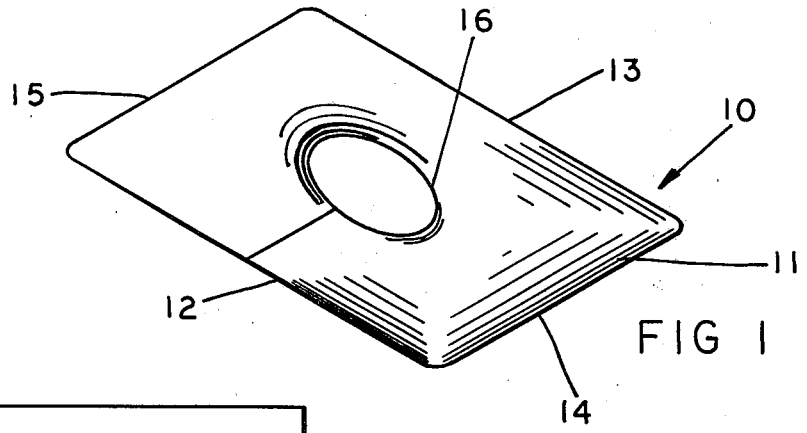
FIG. 1 is an isometric view of the pillow according to the invention with the pillow case removed.
Figure 2:
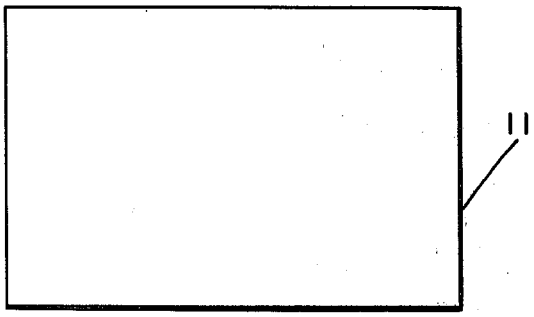
FIG. 2 is a top view of the pillow before the central hole is formed.
Figure 3:
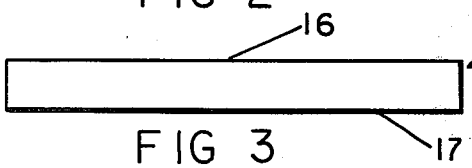
FIG. 3 is an edge view of the pillow.
Figure 4:
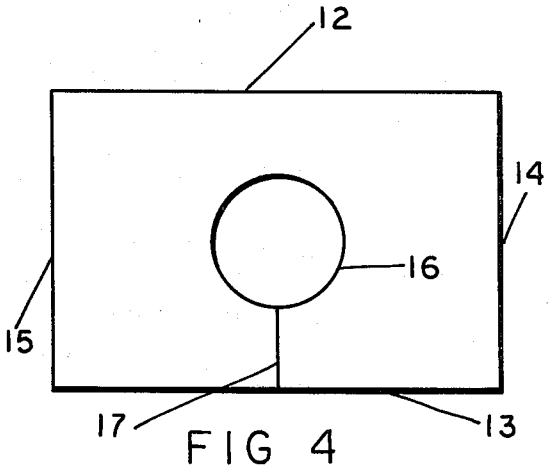

FIG. 4 is a top view of a pillow, indicated by numeral 110, in which the cut 17 runs from hole 16 toward an end edge.

Figure 5:
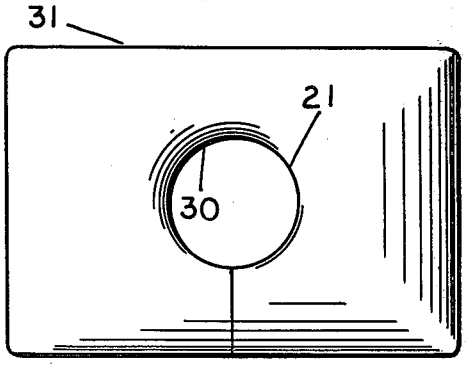

FIG. 5 is a top view of the pillowcase on a pillow with rounded edges.

Figure 6:
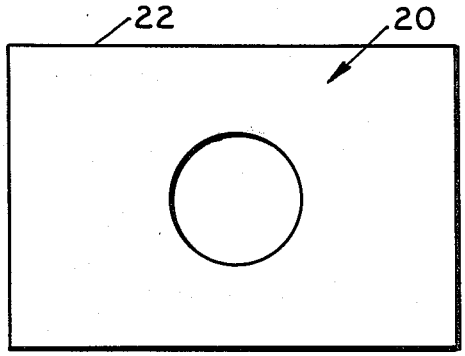

FIG. 6 is a top view of the pillow case for use with the pillow.

DETAILED DESCRIPTION OF THE DRAWINGS

Now, with more particular reference to the drawing, the pillow shown is indicated generally at 10. It is generally rectangular in shape and has two sides with edges 12 and 13 and two ends with edges 14 and 15 and a central opening 16.

The edges of the pillow 12, 13, 14 and 15 as well as the edges of the hole 16 are rounded.

The pillow may be made of plastic foam, foam rubber or any other suitable material and the edges of sides 12, 13, 14, 15 and opening 16 will be squeezed together and cemented around the periphery 21 defining said opening and along side edges 12, 13, 14, and 15 at 21 and 22 to hold the top and bottom together along the edges in the contour shape disclosed.

The pillow is cut laterally from the hole 16 to the edge along the line 17 which connects the hold 16 to any of the four edges.

The side edges of the pillow may have cement applied to them and the top and bottom adjaent the edges may be squeezed together and clamped together to form the contoured edge. The pillow case indicated generally in FIG. 6 at 20 has a central opening and the outer edges of the pillowcase which are substantially the same size as the pillow, are hemmed, as indicated by numeral 22. Thus, the pillow can be inserted into the pillow case.

The pillow case may have a zipper 30 around the inside or a zipper 31 around the outside or both to allow the pillow case to be replaced or the seams could be sewed or held by any fasteners.

The embodiment of FIG. 6 shows a pillow case with a hole cut in the top to overlie the hole in the pillow.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A pillow and pillow case for protecting a hairdo comprising a pillow body made of a foam material, the pillow being generally rectangular in shape having two sides and two ends and a central opening, the edges of said sides, ends and opening of said pillow being curved by having upper and lower surface on the sides and ends cemented together to form a rounded edge around the outer periphery of said pillow and around said opening, said pillow case having a central opening and being adapted to receive the pillow, said pillow being cut from one said side edge to said opening, said pillow case having a central opening and the outer edges of said pillow case being hemmed, providing a space to receive said pillow whereby said pillow can be inserted into said pillow case, and a zipper around the outside of said pillow case permitting the removal of said pillow from said pillow case.

* * * * *